United States Patent [19]

Hidding

[11] Patent Number: 4,744,483

[45] Date of Patent: May 17, 1988

[54] TAMPER EVIDENT COVER

[76] Inventor: Daniel P. Hidding, Rte. 2, Ridgecroft La., Barrington Hills, Ill. 60010

[21] Appl. No.: 17,862

[22] Filed: Feb. 24, 1987

[51] Int. Cl.[4] ..... B65D 17/34

[52] U.S. Cl. ..... 220/270; 222/182; 220/319

[58] Field of Search ..... 220/270, 319; 215/254, 215/274; 292/256.6, 256.61; 222/182

[56] References Cited

U.S. PATENT DOCUMENTS 4,485,932 12/1984 Kusz ..... 215/224

*Primary Examiner*—George T. Hall

*Attorney, Agent, or Firm*—Lee, Smith & Zickert

[57] ABSTRACT

A tamper evidencing covering for containers, comprising a hollow container cover and a frangible ring shaped to fit about the cover. The cover includes an external annular retention recess for accommodating the frangible ring, and an annular internal locking bead for affixing the cover to a container. The bead may be segmented, or one or more vertical slots may be provided in the retention recess to relieve the gripping strength of the cover when on a container.

8 Claims, 1 Drawing Sheet

FIG. 1
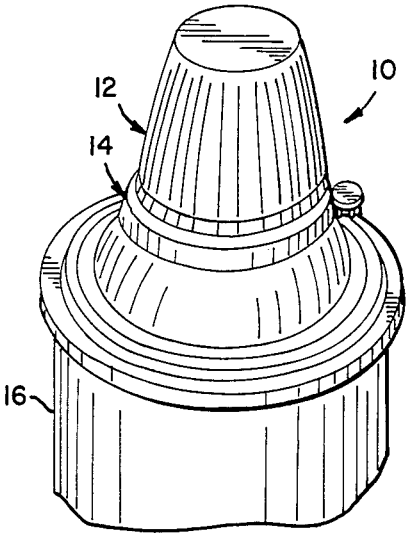
FIG. 2
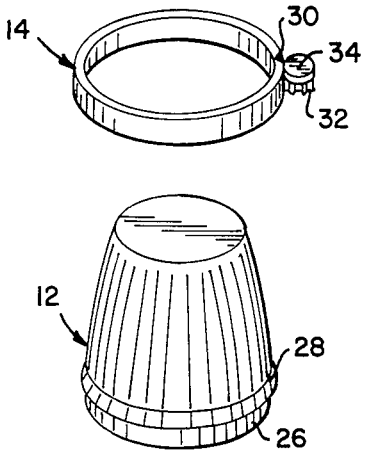
FIG. 3
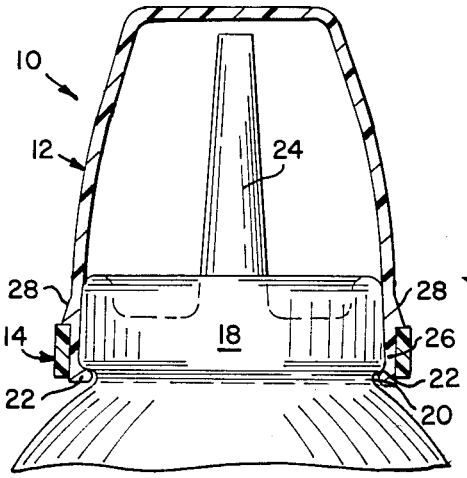
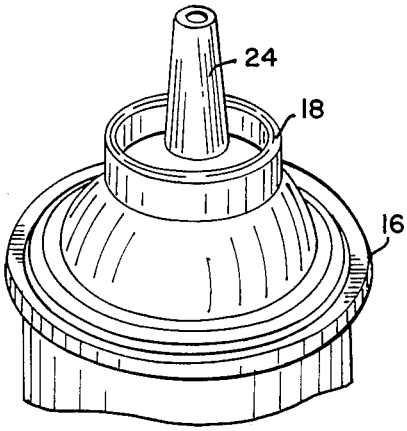
FIG. 4
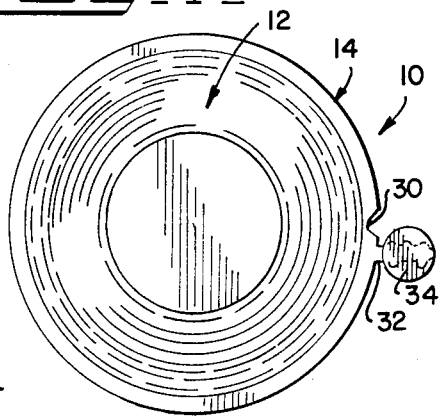
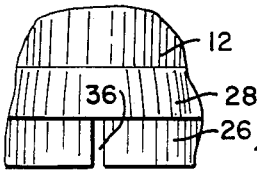
FIG. 5

TAMPER EVIDENT COVER

BACKGROUND OF THE INVENTION

This invention relates to covers for containers, and in particular to a tamper evidencing cover having a seal which can be broken in order to gain entry to the contents of the container, and which after being broken cannot be replaced.

Typical covers for containers such as aerosol cans snap onto the top of the can and are readily removable. Such a cover includes an annular internal bead about the periphery of the cover which is snapped over a lip or which is engaged in a corresponding channel formed in the can body in order to retain the cover on the container.

As concerns with the integrity of the contents of the containers have become acute, various means for protecting the contents and evidencing tempering or previous access to the contents have been devised. For example, often containers are simply covered in whole or in part by a heat-shrinkable plastic, which encapsulates the container and which must be removed before access to the container is possible. Other means include locking lids, which must be partially broken or have portions removed in order to gain access to the container.

SUMMARY OF THE INVENTION

The present invention relates to protecting the integrity of contents of a container, but rather than resorting to cumbersume wrappings or covers which are destroyed or which have integral portions removed, provides a cover having a separate part which evidences tampering or access to the contents, with the cover being readily replaceable by the user to protect the container after initial opening.

The invention provides a tamper evidencing covering for containers. The covering is composed of removable, separate first and second portions, the first of which comprises a hollow container cover. The cover includes an orifice for accommodating a container and has an external annular retention recess adjacent the orifice. The cover also includes internal locking means adjacent the orifice to permit the cover to be affixed to a container. The second portion of the tamper evidencing covering comprises a frangible ring which is shaped to fit within the recess in the cover. The ring is formed with means to assist breaking of the ring upon application of opening force thereto.

The internal locking means in the cover comprises an annular bead extending into the interior of the cover. In accordance with one form of the invention, the bead can be segmented to permit easier removal of the cover from the container after the ring is removed. In accordance with another form of the invention, to also ease removal and reduce the grip of the cover, at least one slot is provided in the cover in the retention recess, with the slot extending entirely through the cover and the bead.

The ring includes a shear section, and the means to assist breaking of the ring comprises a tab which extends radially outwardly from the ring adjacent the shear section. The shear section may comprise an integral notch in the ring. The extending tab may be topped with a finger engagement platform to aid breaking of the ring.

The retention recess in the cover comprises a cylindrical skirt in the cover at the orifice and an annular collar which extends outwardly from the cover adjacent to the skirt. The frangible ring is installed on the cover when in place on a container, and is drawn tightly about the cover in the retention recess.

BRIEF DESCRIPTION OF THE DRAWINGS

The invention is described in greater detail in the following description of examples embodying the best mode of the invention, taken in conjunction with the drawing figures, in which:

FIG. 1 is a perspective view of the invention when installed on a container,

FIG. 2 is an exploded assembly perspective view of the form of the invention illustrated in FIG. 1, FIG. 3 is an elevational view, in cross section through the tamper evidencing covering according to the invention, when installed on a container, FIG. 4 is a top plan view of the tamper evidencing covering illustrated in FIG. 3, but with the container omitted, and FIG. 5 is a cut-away view of a lower portion of the periphery of the tamper evididencing covering according to the invention, illustrating a second form of the invention.

DESCRIPTION OF EXAMPLES EMBODYING THE BEST MODE OF THE INVENTION

The tamper evidencing covering according to the invention is designated generally at 10 in the drawing figures, and is composed of two primary components, a first portion comprising a cap or cover 12, and a second portion comprising a frangible ring 14. For purposes of illustration, the covering 10 is illustrated in combination with a container 16, and it will be evident that depending on the size of the covering 10, various types and sizes of containers can be accommodated.

The cover 12 is shaped to be installed on the cylindrical, upstanding neck 18 of the container 16. The neck 18 includes an annular channel 20 therein, and the cover 12 is provided with a corresponding annular internal locking bead 22 for affixing the cover 12 to the neck 18 of the container 16. The cover 12 is dome-shaped, as necessary, to accommodate a spout 24 or other protruding outlet that might be found on the container 16.

The cover 12 includes an external annular retention recess in the form of a flat, cylindrical skirt 26 adjacent the mouth or orifice of the cover 12. An annular integral collar 28 extends outwardly from the cover 12 adjacent the skirt 26 to complete the retention recess.

The ring 14 is shaped to fit tightly about the cover 12 at the skirt 26, abutting the collar 28, when the cover 12 is placed on the container 16. The ring 14 is intended to be sheared or broken when removed, and therefore includes a notch 30 therein, as best shown in FIG. 4, which weakens the material of the ring 14 at the notch 30, making the ring 14 breakable at that location. To aid in breaking of the ring 14 and its removal, the ring 14 is also provided with a radially outwardly extending tab 32 immediately adjacent the notch 30. The tab 32 is topped with a small, circular disk 34 forming a finger engagement platform atop the tab 32.

It is preferred that both the cover and the ring 14 are formed of a plastic material, which can readily injectioned molded. To assemble the covering 10, the cover 12 is first installed on the neck 18 of the container 16, and the ring 14 is then forced over the annular collar 28 and is seated against the skirt 26. The ring 14 prevents the removal of the cover 12 unless the ring is broken and removed. Once the ring 14 is in place, the bead 22 is retained snugly within the channel 20, and the cover 12 cannot be removed. If sufficient force were applied to the cover 12 for its removal with the ring 14 yet in place, the cover 12 would stretch sufficiently at the skirt 26 to break the ring 14 at the notch 30, showing that the container 16 has either been tampered with or the cover 12 has been inadvertently removed.

The ring 14 is normally removed by the user by exerting downward pressure on the disk 34. Such pressure will shear the ring 14 at the notch 30, permitting its removal and subsequent access to the contents of the container 16. Because the collar 18 is barbed, the ring 14 cannot be removed from the cover 12 without shearing at the notch 30. The only practical manner to remove the cover 12 is to first remove the ring 14.

The bead 22 normally is continuous about the inner periphery of the cover 12. On occasion, the bead may be segmented to reduce somewhat the force necessary to remove the cover 12 from the container 16 after the ring 14 has been removed. Also, if the cover 12 is difficult to remove or if the plastic material of the cover 12 is relatively stiff, as shown in FIG. 5, the cover 12 can be provided with one or more vertical slots 36 through the skirt 26, terminating at the collar 28. It is evident that the slots 36 are, when the covering 10 is assembled, covered by the ring 14. Once the ring 14 is removed, the slots 36 permit removal of the cover 12 with much less force than would be required if the engagement surface and bead were formed continuously.

It will be evident that the covering 10 can assume other sizes and shapes, depending on the type of container being covered and the nature of any spout or outlet located on the container. In the example illustrated in the drawing figures, the cover 12 is generally dome-shaped to accommodate a large spout 24, such as that found on a whipped cream container. Spray containers may have shorter spouts, and therefore the extent of the cover 12 can reduced accordingly.

Various changes can be made to the invention without departing from the spirit thereof or scope of the following claims.

What is claimed is:

1. A tamper evidencing covering for containers, comprising:

a. a removable first covering portion comprising a hollow container cover, b. an orifice in said cover for accommodating a container, c. a retention recess adjacent said orifice, said recess comprising a flat, cylindrical skirt in said cover at said orifice and an annular collar extending outwardly from said cover adjacent said skirt, d. an annular internal locking bead adjacent said orifice for affixing said cover to a container, said bead extending into the interior of said cover, e. a removable second covering portion comprising a frangible ring shaped to fit within said recess, said ring including a weakened notch therein for facilitating breaking of said ring at said notch, and f. a tab extending radially outwardly from said ring adjacent said notch.

2. A covering for containers according to claim 1 in which said bead is segmented.

3. A covering for containers according to claim 1 including at least one slot through said cover in said retention recess, said slot extending from said orifice to said collar.

4. A covering for containers according to claim 1 in which said tab includes a finger engagement platform.

5. A container having a tamper evidencing cover, comprising:

a. a container body having a cylindrical upstanding neck, said neck including an annular channel therein, b. a removable first covering portion comprising a hollow container cover, c. an orifice in said cover for accommodating said neck, d. a retention recess adjacent said orifice, said recess comprising a flat, cylindrical skirt in said cover at said orifice and an annular collar extending outwardly from said cover adjacent said skirt, e. an annular internal locking bead adjacent said orifice and extending into the interior of said cover, said bead beind shaped to engage said channel for affixing said cover to said neck, f. a removable second covering portion comprising a frangible ring shaped to fit within said recess, said ring including a weakened notch therein for facilitating breaking of said ring at said notch, and g. a tab extending radially outwardly from said ring adjacent said notch.

6. A covering for containers according to claim 5 in which said bead is segmented.

7. A covering for containers according to claim 5 including at least one slot through said cover in said retention recess, said slot exending from said orifice to said collar.

8. A covering for containers according to claim 5 in which said tab includes a finger engagement platform.

* * * * *